US008507848B1

(12) United States Patent
Ding et al.

(10) Patent No.: US 8,507,848 B1
(45) Date of Patent: Aug. 13, 2013

(54) WIRE ELECTRODE BASED ION GUIDE DEVICE

(75) Inventors: Li Ding, Manchester (GB); Gongyu Jiang, Shanghai (CN); Wenjian Sun, Shanghai (CN)

(73) Assignees: Shimadzu Research Laboratory (Shanghai) Co. Ltd., Shanghai (CN); Shimadzu Corporation, Kyoto (JP)

( * ) Notice: Subject to any disclaimer, the term of this patent is extended or adjusted under 35 U.S.C. 154(b) by 0 days.

(21) Appl. No.: 13/357,470

(22) Filed: Jan. 24, 2012

(51) Int. Cl.
*H01J 49/42* (2006.01)
*H01J 49/34* (2006.01)
*H01J 49/04* (2006.01)

(52) U.S. Cl.
USPC ..... 250/286; 250/281; 250/282; 250/284; 250/288; 250/396 R

(58) Field of Classification Search
USPC ..... 250/281, 282, 284, 286, 288, 396 R
See application file for complete search history.

(56) References Cited

U.S. PATENT DOCUMENTS

| | | | | |
|---|---|---|---|---|
| 3,501,631 | A * | 3/1970 | Arnold | 250/281 |
| 5,179,278 | A | 1/1993 | Douglas | |
| 5,206,506 | A * | 4/1993 | Kirchner | 250/281 |
| 5,572,035 | A * | 11/1996 | Franzen | 250/396 R |
| 5,811,800 | A * | 9/1998 | Franzen et al. | 250/288 |
| 5,811,820 | A * | 9/1998 | Kirchner et al. | 250/432 R |
| 5,818,055 | A * | 10/1998 | Franzen | 250/292 |
| 6,107,628 | A * | 8/2000 | Smith et al. | 250/292 |
| 6,462,338 | B1 * | 10/2002 | Inatsugu et al. | 250/292 |
| 6,727,495 | B2 * | 4/2004 | Li | 250/286 |
| 6,762,404 | B2 * | 7/2004 | Bateman et al. | 250/281 |
| 6,894,286 | B2 * | 5/2005 | Derrick et al. | 250/396 R |
| 6,911,650 | B1 * | 6/2005 | Park | 250/292 |
| 6,992,284 | B2 * | 1/2006 | Schultz et al. | 250/287 |
| 7,095,013 | B2 | 8/2006 | Bateman et al. | |
| 7,391,021 | B2 * | 6/2008 | Stoermer et al. | 250/292 |
| 7,595,486 | B2 * | 9/2009 | Franzen | 250/288 |
| 8,134,123 | B2 * | 3/2012 | Nishiguchi et al. | 250/292 |
| 8,288,717 | B2 * | 10/2012 | Park | 250/288 |
| 2011/0168882 | A1 * | 7/2011 | Hoyes | 250/283 |

FOREIGN PATENT DOCUMENTS

CN 102339719 A 2/2012

* cited by examiner

*Primary Examiner* — David A Vanore
(74) *Attorney, Agent, or Firm* — Morris Manning & Martin LLP; Tim Tingkang Xia, Esq.

(57) ABSTRACT

This invention presents a kind of ion guide device comprising multiple layers of stretched wire electrodes crossing in space. These wire electrodes are distributed along a defined ion guiding axis in the ion guide device. Each layer of wire electrodes contains at least two wire electrodes with some distance away from the guiding axis, and rotates with an angle relative to wire electrodes on neighboring layer. The ion guide contains multiple layers of wire electrodes to form a cage-like ion guide tunnel and keeps the mounting framework of those wire electrodes outside of the ion guide tunnel, thus reducing the interference of the gas flows from the ion guide device. A power supply provides voltage to each layer of wire electrodes, creates an electric field which focuses the ions towards the guiding axis.

33 Claims, 16 Drawing Sheets

WIRE ELECTRODE BASED ION GUIDE DEVICE

FIELD OF THE INVENTION

This invention relates to an ion guide device, especially being capable of introducing ions from higher pressure (or low vacuum) environment into a low pressure environment for mass spectrometry analysis.

BACKGROUND OF THE INVENTION

In the field of mass spectrometry in order to introduce ions from ion source into mass analyzer at higher pressure ($1\sim10^4$ Pa or 0.0075~75 torrs), a high-frequency (or RF) guiding device is normally used. The effective potential barrier formed with the high frequency voltage applied on the electrodes in this device would accelerate ions towards the central axis for focusing. The ions will lose a large portion of their kinetic energy due to collisions with the neutral gas molecules, and hence ions would be confined in the vicinity of the central axis before passing through the aperture for differential pumping and entering into the lower pressure region of a mass spectrometer. This kind of RF focusing device has different variations including D. J. Douglas' initial invention of the multi-pole guide system (U.S. Pat. No. 5,179,278), R. D. Smith's ion funnel (U.S. Pat. No. 6,107,628), N. Inatsugu, H. Waki's Q-array device (U.S. Pat. No. 6,462,338B1), and Bateman's (U.S. Pat. No. 7,095,013) travelling wave ion guide. However, as the first ion guide right after the ion source, it would experience very strong gas flow induced by the pressure difference. Sometimes the effect of the gas flow on the ions is even stronger than that of the electric field. In such case, the electrodes themselves, or their mounting brackets often inevitably interfere with the gas flow. In addition, the effect of the position of the pipes on pumping may also cause turbulence or flow jitter on the ion path, and further affect the transmission of the ions.

In the U.S. Pat. No. 5,572,035, the inventor Franzen has proposed to use wire electrodes to form ion reflector in order to confine ions. This reflector design can theoretically have good transmission for gas molecules. But generally the meshes are very soft, and the inventor did not give an example of how to securely install them at a specific location without effects from the air flow. If mounted with additional brackets, the additional brackets will also affect the direction of the gas flow. In U.S. Pat. No. 7,391,021, they raise a structure to confine ions in a serial set of stacked RF diaphragm, but the slimsy diaphragms are still with high risk to be shape-changed under high flow rate toward its axis.

In addition, in the ion guiding devices developed in the past, the opposite phases of the high frequency voltages applied on adjacent electrodes (either parallel to each other (between lines or between surfaces), or being concentric rings or arcs) would create very large capacitance between electrodes. For example, U.S. Pat. No. 6,107,628 described an ion funnel design using sheet electrodes for applying voltages with opposite polarity. Similar structure was also introduced in U.S. Pat. No. 7,595,486's RF multipole design. Two groups of adjacent wires with opposite phase RF superimposed are placed all parallel to shape a pole rod surface for confining the ions inside.

In these design, the power consumption of the power supply is very large due to the large capacitance caused by the multiple parallel layers (this is equivalent to many parallel capacitors for the high frequency power supply).

Therefore, a heretofore unaddressed need exists in the art to address the aforementioned deficiencies and inadequacies.

SUMMARY OF THE INVENTION

One of the purposes of this invention is to design an ion guide device which can efficiently focus ions at high pressure and high gas flow conditions in a low-vacuum region. This device should be able to minimize the adverse impact of ion guide structure on the neutral gas flow and to minimize the capacitance between electrodes.

In order to reduce the impact of electrode structure on the gas flow, this invention proposes to use wire electrodes to generate the required electric field. However, due to the lack of rigidity of the wire electrodes, it is difficult to precisely fix them in space. Therefore, one need find a good way of fixing the electrodes in space to form appropriate electrode geometry. In addition, the wire electrodes formed in space will have to not only form the required electric fields, but also meet the conditions of minimized inter-electrode capacitance.

This invention presents a kind of ion guide device consisting of multiple layers of stretched wire electrodes distributed along a defined ion guide axis in the ion guide device. Each layer of the wire electrodes contains at least two wire electrodes with some distance away from the ion guide axis, and rotates with an angle relative to their adjacent layers of wire electrodes. The ion guide contains multiple layers of wire electrodes to form a cage-like ion guide channel. A power supply provides voltage to each layer of the wire electrodes, and creates an electric field which focuses the ions towards the ion guide axis.

As a preferred embodiment of the invention, the plane for each layer of the wire electrodes is roughly orthogonal to the said ion guide axis, and the angle between the two ranges from 85° to 95°. In other embodiments of the invention, the angle between the said plane and the said ion guiding axis can be expanded to between 70° to 110°.

As an embodiment of the present invention, it also proposes that each layer of the wire electrodes contains a pair of stretched thin wires equally spaced from the ion guide device. Each layer of the wire electrodes is substantial perpendicular (90 degrees relative) to the next layer of electrodes, and the phases of the high frequency voltages applied on the adjacent pairs are opposite.

As a preferred embodiment of the invention, it also involves reducing the distance between the wire electrodes and the ion guide axis to form a funnel type ion guide device for the purpose of improving ion focusing effect and reducing the adverse effect of the gas flow.

In the embodiment of the present invention, the angle between each layer of wire electrodes and its adjacent layer around the ion guide axis can have multiple variations. For example, the angle can be 360/N degrees, for which N=4, 5, 6, 7, 8, 9, 10, 11 or 12. Thus, we can construct the quadrupole field, hexapole field, octapole field and so on. In some embodiments, the shape of each layer can be formed with wire electrodes with different geometry such as triangle, pentagon and other polygons.

In the embodiment of the present invention, there are several ways of forming the electric field to focus ions towards the ion guide axis. For example, one can provide high frequency voltages to the adjacent electrodes with different phases which could be opposite phases or phase difference being 360/M degrees (M is an integer greater than 1) The amplitude of the high-frequency voltages can be changed. In another example, DC voltages can be provided to wire electrodes on each layer in order to form a gradually changing DC gradient along the ion guide device and its components contain electric field which can focus ions towards the ion guide axis.

In the embodiment of the present invention, the high frequency voltage source includes a number of high-frequency high-voltage switches in order to generate high-frequency square wave voltage.

In the embodiment of the present invention, one can also apply different DC potential to at least some of the wire electrodes so that a potential gradient can be formed along the direction of the ion guide axis.

In the embodiment of the present invention, the ion guide axis cannot only be straight line, but also be curved lines. In this or other embodiments one can further include a DC voltage source to provide a DC potential difference between the opposite wire electrodes of the same pair for at least some of the layers in order to bend the ion beam along the ion guiding axis.

In the embodiment of the invention, gas flow exists in at least part of the ion guide device, and the ion drift direction caused by the potential gradient is opposite to the direction of the gas flow so that only ion with specific mobility can be transmitted effectively.

In one embodiment of the invention, the space settings between wire electrodes and high frequency voltage setting for at least part of the layers will make the ions entering the ion guide device pass, being blocked, or splattered mass selectively near the wire electrodes.

In another embodiment of the invention, the high voltage settings and the potential gradient settings along the ion guide axis will make the ions collide with the neutral gas molecules effectively, and efficiently transmit the product ions, fragment ions, or desolvated ions.

In the embodiment of the invention, gas flow exists in at least part of the ion guide device, and the pressure of the said gas flow is between 10-10000 Pascal (0.075-75 Torrs). In this gas flow environment, the diameter of the wire electrodes is kept less than 0.5 mm in order to reduce their impact on the gas flow. In order to effectively fix the wire electrodes without the interference of the gas flow, one can mount the wire electrodes of the different layers outside of the cage-like ion guide device for which the fixed support or frame have wire electrodes wound around, soldered, or clamped. In the embodiment for which a relatively enclosed frame was used, one can set exhaust holes on the outer wall of the frame in order to reduce the effect of the gas flow.

The embodiment of this invention also proposes a combination of ion guide device structure which includes multiple said ion guide devices, and at least some of the ion guide devices are aligned in parallel in a first direction in order to achieve convergence and/or divergence of ion guide axes.

Further, in some of the embodiments, at least some of the ion guide devices are aligned in series in order to connect ion guide axes in tandem.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers.

FIG. 3 is a plot showing the potential contours of the high frequency electric field of a funnel-shaped ion guide device according to the present invention, in which FIG. 3A shows the contour lines on the cross-section across the guiding axis, and FIG. 3*b* shows the contour lines on the plane perpendicular to the guiding axis.

DETAILED DESCRIPTION OF PREFERRED EMBODIMENTS

Figure 1:
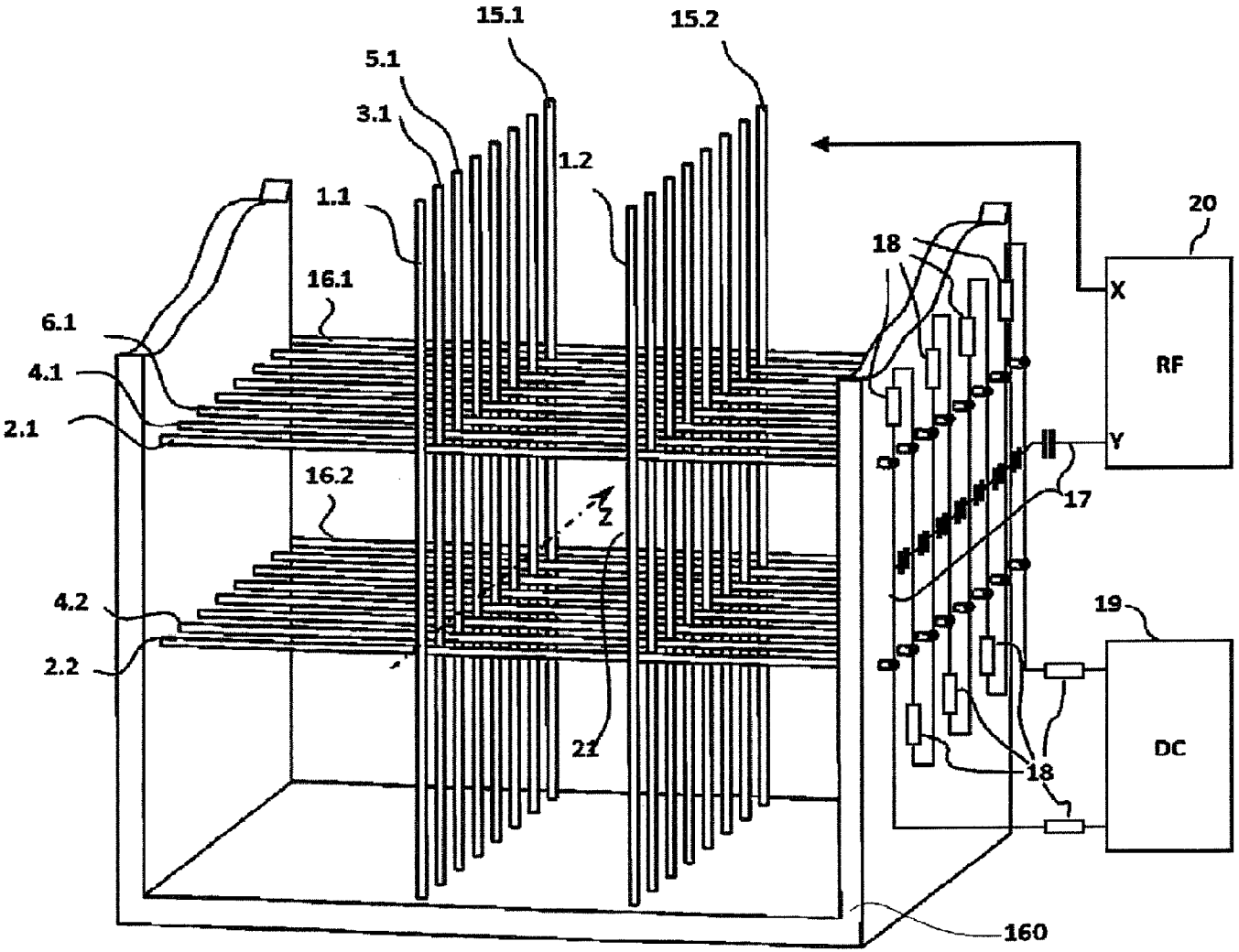
FIG. 1 is a schematic view of a straight wire electrode ion guide and its driving circuit with one embodiment of the invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

Embodiments of the present invention are described below with reference to the accompanying drawings, and in the accompanying drawings like reference numerals represent like elements.

In an ion guide structure which uses alternating electric field for confining those charged particles, the process in converging and guiding charged particles is often interfered by the disturbance of gas flow that trapping electrode structure caused. One method to avoid the interference is to miniaturize scale of these electrodes. Thin sheet or wire electrode structure can avoid unwanted disturbance of gas flow. But these thin structures are usually too slimsy to form a stable geometry under strong flow condition.

In accordance with the present invention, an ion guide device was presented comprising multiple layers of stretched wire electrodes crossing in space. These wire electrodes surround a volume space and form a spatial structure similar as the famous Chinese Pavilion building established in 2010 Shanghai World Expo. This structure of wire electrode system provides high transparence and low interference to the gas flow passing through or across the device. A cage-like ion guide tunnel can be formed around the central axis of the device structure with high transmission for the charged particle streams injected. In order to stabilize the whole structure and the position of each wire electrode, a mounting frame is introduced to fix up all the wires with enough tension, and insulate these separated wire electrode parts. As an optimal parameter, the cross angle of adjacent wire electrodes between a pair of neighboring wire layers are substantially perpendicular to each other with the tolerance of +/−5 degrees. Under such conditions, the parasite capacitance load between neighboring layers can be obviously decreased, thus reducing the power consumption of the AC voltage power supply, especially in high frequency (>100 KHz) or radio frequency (RF, commonly >1 MHz) region. The parasite capacitance load between adjacent layers slightly increases if a larger angle tolerance exists for this kind of perpendicular wire position. But even if the cross angles of wires are reduced to 45 degrees, the inter-parasite capacitance load of this kind of wire ion guide device is still much smaller compared to previous ion guide geometry with substantially parallel neighboring electrode such as the conventional ion tunnel and ion funnel presented in the prior arts.

The schematic view FIG. 1 illustrates an example of this kind of wire ion guide consisting of a plurality of straight wire electrodes. The following description only helps to describe the principle of the present invention comprehensively. But those some definite parameters such as the number of wire layers and electrodes would not be limited in what we have given in present description for the ion guide device in present invention.

In the ion guide device shown in FIG. 1, there are sixteen layers of wire electrodes distributed along the central guiding axis, so-called as Z axis. The form of wire distribution in each wire layer is similar in general. Each layer contains a pair of straightened wire electrodes N.1, N.2 parallel to each other, and equidistant to z-axis (N is the number of layers in this embodiment, $1 \leqq N \leqq 16$). In a neighboring pair of layers, the placement of wire electrodes 2.1, 2.2 in the second layer is perpendicular to the wire electrodes 1.1, 1.2 in the first layer. Therefore, all wires of the second layer was rotated around the guide Z axis by 90 degrees relative to the all corresponding wire electrodes in the first layer, thus all wire layers formed a cage-like guiding tunnel 21 along the Z axis. All wires were stretched straight with tension and fix up on the frame bracket 160. All wire electrodes in the even layers (N.1, N.2, N is an even number such as 2, 4, 6, . . . , 16) are connected to one output phase node Y of a high-frequency power supply 20 through the capacitor networks 17. Similarly, all wire electrodes in the odd layers (N.1, N.2, N is an even number such as 1, 3, 5, . . . , 15) are connected to another opposite output phase node X by another capacitor network in general pattern omitted in this figure. For convenience, the bracket 160 can be made by printed circuit board (PCB), or made of other materials with enough strength as the frame body, and then attaches the printed circuit board for wire linking. As a simple method to fix the wire electrodes, wires can pass through some holes on the printed circuit board, and then be soldered on the pads of PCB.

Generally, in the ion device described in FIG. 1, all layers of wire electrodes have the substantial similar structure comprising two parallel wires. Alternatively, in each of the layers, the distance between the pair of wires can be also changed in a certain range. For example, in order to transmit common 10~100K Dalton molecular ions, the distance between wire electrode to Z-axis are typically between 0.01~10 mm, the radio frequencies of the applied AC potential on wire electrodes are typically between 0.1~10 MHz, and the applied voltages typically range between +/−1000 volts.

In order to reduce the power consumption of the RF power supply for the ion guide, the capacitance load between different layers was reduced by introducing none-zero cross angle between different adjacent layers. Relative thin wire electrodes also help to reduce the power consumption for RF driving especially when high amplitude and frequency RF voltage is applied, which strongly focuses the ion beam through the ion guide device towards its central guiding axis. To avoid the risk of RF discharging between wire electrodes, and suppress the escape of confined ions due to the diffusion of neutral background molecular, commonly wire electrodes and the axis of ion guide should be within enough distance. Considering the adverse effect cause by the fringe field around the cross position of near wires, the proper value of this distance should be no less than 1 millimeter.

The described ion guide apparatus works properly particularly when a gas or molecular flow existed in at least a part of the ion guide structure. The open structure of the ion guide can transmit ions along the ion guide axis without the disturbance on or from the flow in a proper pressure. Typically, the proper pressure of the flow region should be in the range between 0.075 Torr and 75 Torrs.

As an alternative solution for fewer disturbances to gas flow, the diameter of the wires should be equal or less than 0.5 mm. Typically, metal wires such as copper, nickel and stainless steel wire can be used to fabricate the wire electrode. For increasing the surface conductivity of the electrodes, the wire can be plated with a thin layer of high electric conductive materials, such as gold or silver. Under this treating method, the inner body of the wire electrode can be insulator. Both high elastic material, rubber for example, and high strength material, such as quartz glass fiber or capillary, can be used as the inner insulator, and support several segmented wire electrodes on a single wire structure.

In order to form an axial electric field in the guiding tunnel 21, different DC bias potential can be superimposed to each wire layer by a DC power supply 19 through a multiple-node voltage divider 18. Each layer of wire electrodes was connected by one component of voltage divider 18 to produce an axial DC potential gradient along the guiding tunnel 21, which helps to promote the transmission efficiency and lower speed of ions in the ion guide device, especially under a relatively higher working pressure over 0.1 Torr.

Figure 2:
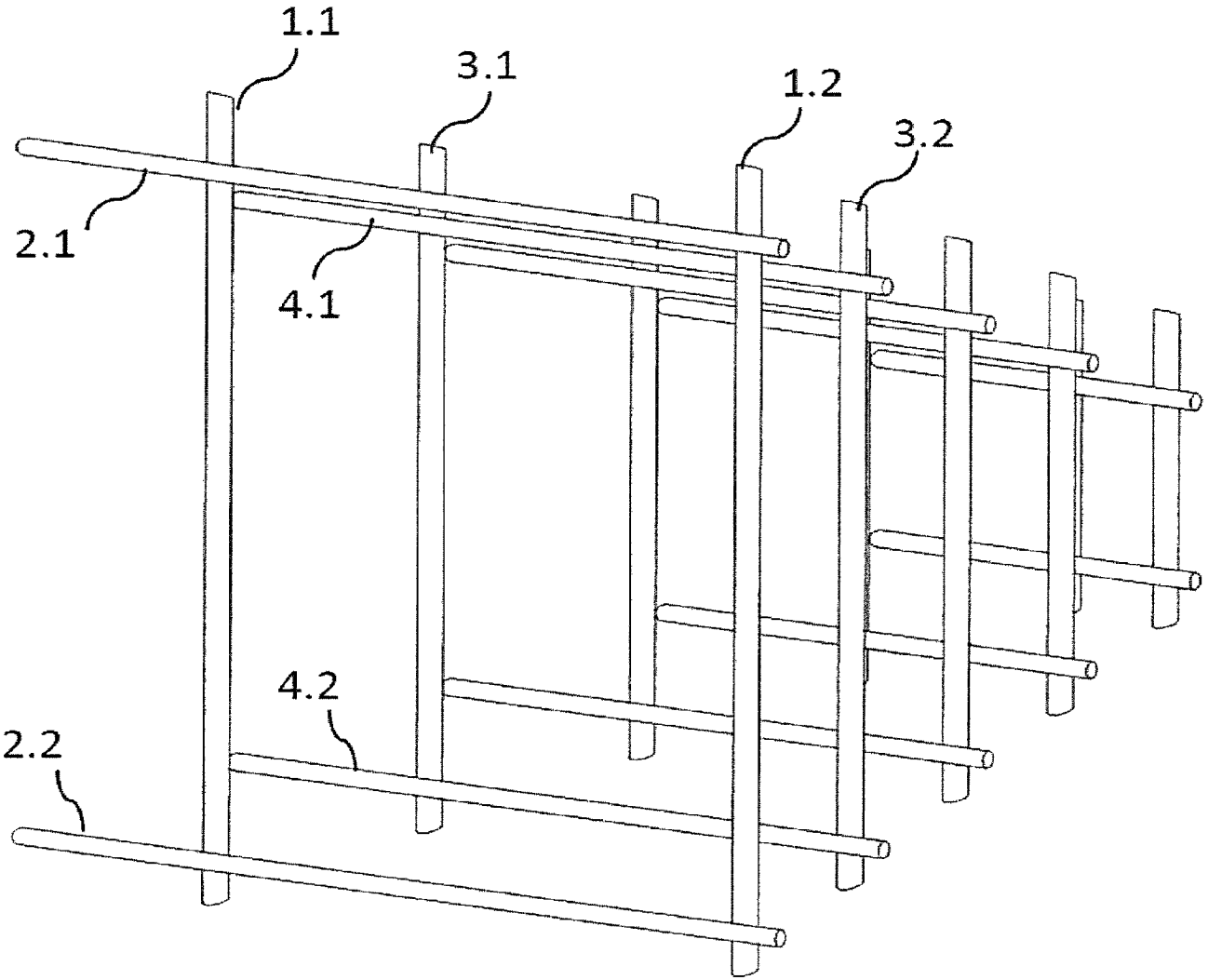
FIG. 2 is a perspective view of a funnel-shaped ion guide comprising straight wire electrodes according to the present invention.

In the embodiment of present invention illustrated by FIG. 1, all wire electrodes are equidistant with the central guiding axis Z. Actually, the distance between wire electrode and guiding axis can be altered for beam shaping. In another embodiment, FIG. 2 illustrated an ion guide structure with shrinking of in-layer wire distance along the guiding axis. This structure has a large entrance, which brings large acceptance area to injected ions with disperse distribution. During the ions' transmission, the ion beam moving forward was converged by increasingly radial RF pseudo potential. This ion guide structure can adapt a wide ion beam into a small aperture exit which acts like in an ion funnel.

Figure 3:
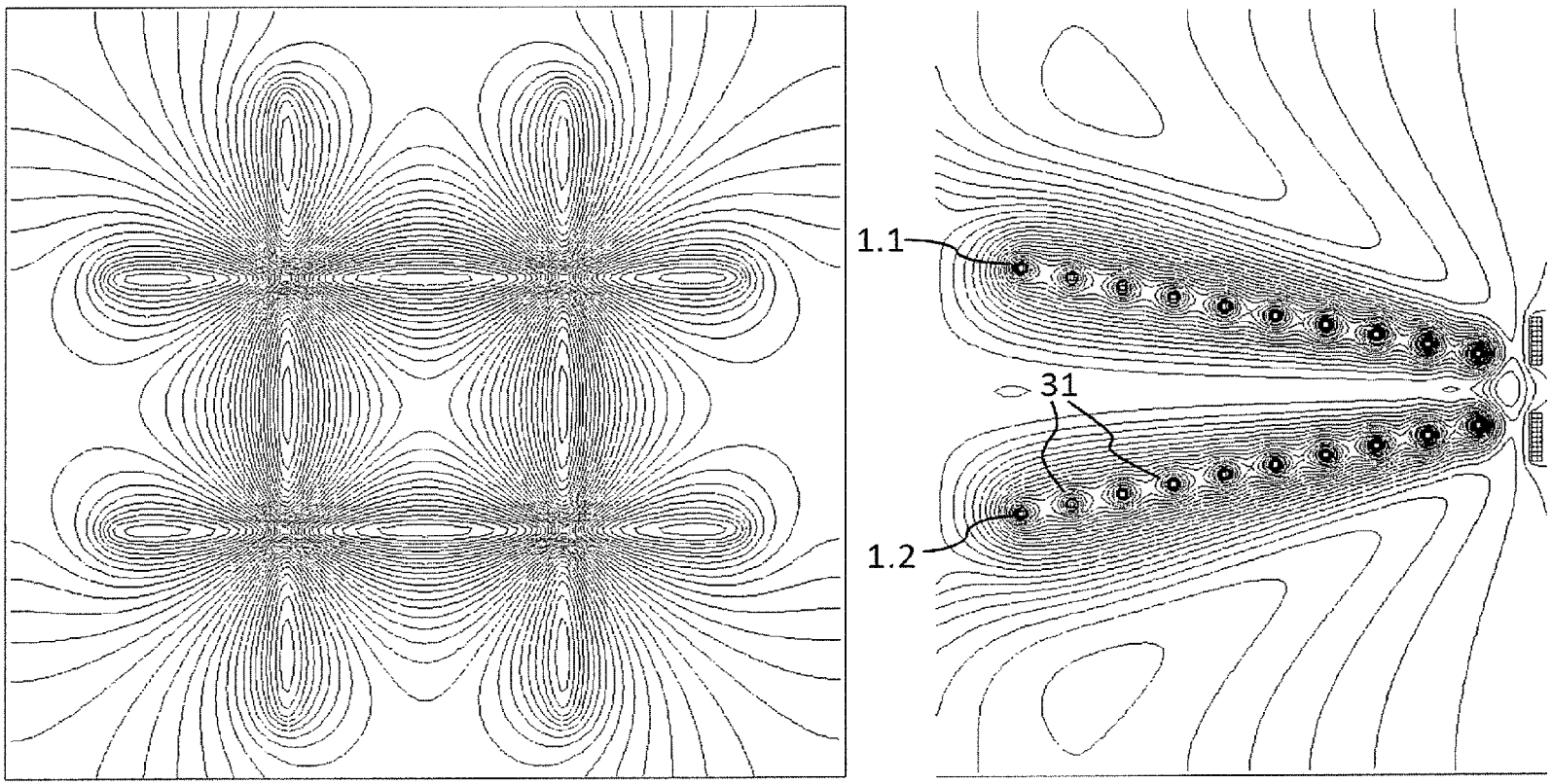

FIG. 3 shows the internal electric field distribution in such an ion guide device shown in FIG. 2. The characteristics of radial trapping field can be seen from the equipotential contour plot obtained on the middle interval position between in the first layer and second layer. Obviously, the radial electric field distribution inside the guiding tunnel is substantial quadrupole field. This is the major difference between this embodiment and conventional stacked ring structure "ion funnel" device. In conventional stacked ring devices, the rotational symmetry majorly creates localized high order field around the ring electrodes, and the high order field plays as an "effective rebounding boundary" only for those ions moved close to the real device inner boundary. But in this ion guide device, the radial RF quadrupole field induced a global radial trapping field in which ions converges in all the trapping volume, no matter whether they are close to the axis or close to the boundary of the ion guide.

The electric field distribution in this funnel shape ion guide device is also different from that in another kind of conventional ion guide device which is quadrupole rod sets. FIG. 3 shows the longitudinal equipotential contour profile in funnel shape wire ion guide device. It can be observed that in the area near the ion guide axis, the increasing trend of the radial potential is similar to that in common quadrupole ion guide. But in the area around the funnel boundary composed of pair of wire electrodes 1.1 and 1.2, the pseudo-potential gradient increases exponentially and the equipotential contours 31 have concentric round shape. In such case the ions would move around the boundary of this funnel shape and are prevented escaping from this "basket" funnel. This is similar to the situation where the ions undergo a strong rebounding force as in the conventional stacked ring ion funnel.

Figure 4:
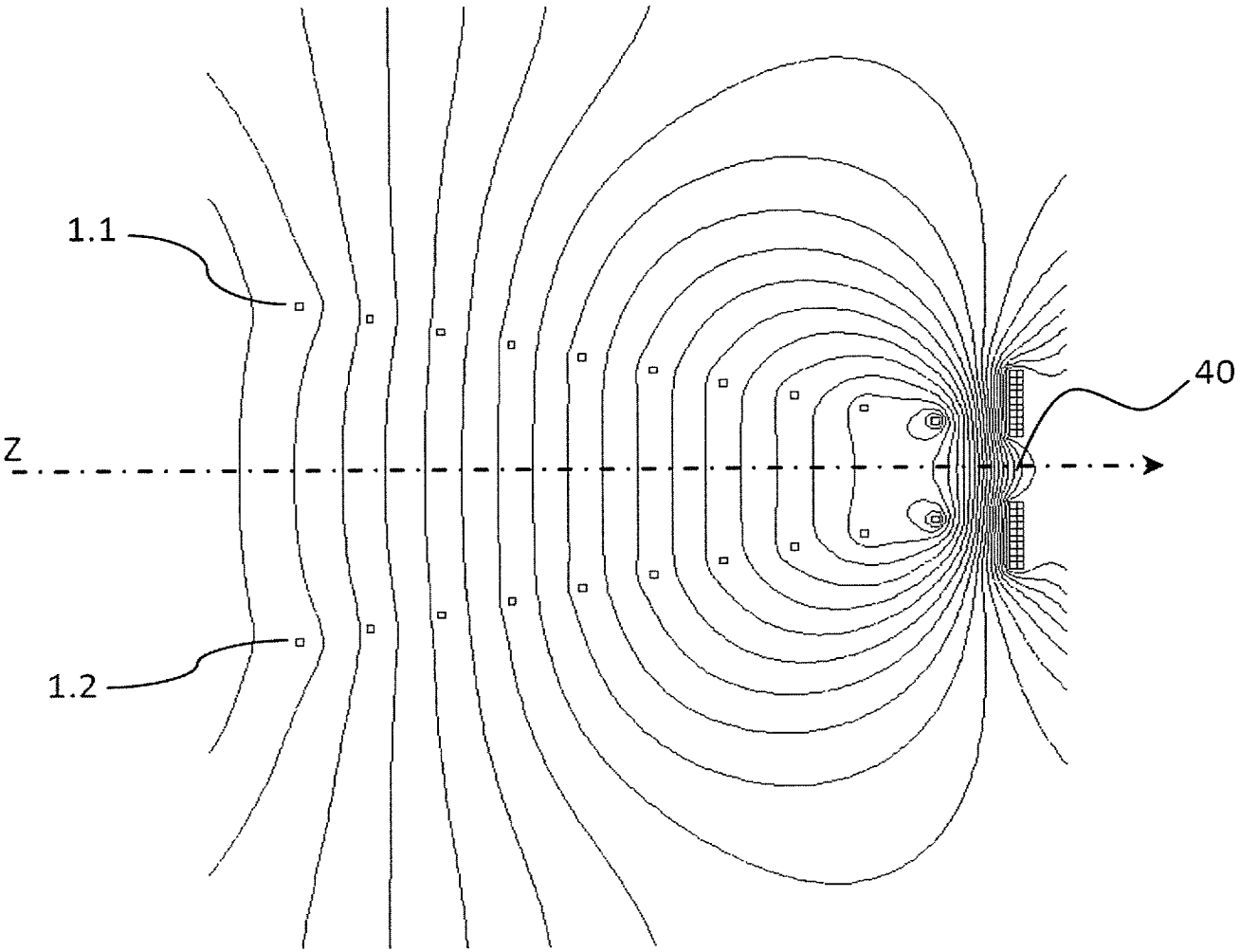
FIG. 4 is a plot showing the axial potential distribution formed with the DC potential applied on the wire electrodes of ion guide device shown in FIG. 3.

FIG. 4 shows the axial DC potential distribution formed by the voltage divider resistors is uniform along the guiding axis. This potential gradient can help accelerate the ions along the guiding axis, to avoid long residence time for the transferred ions before they exit the aperture 40 and enter the next vacuum stage.

Figure 5:
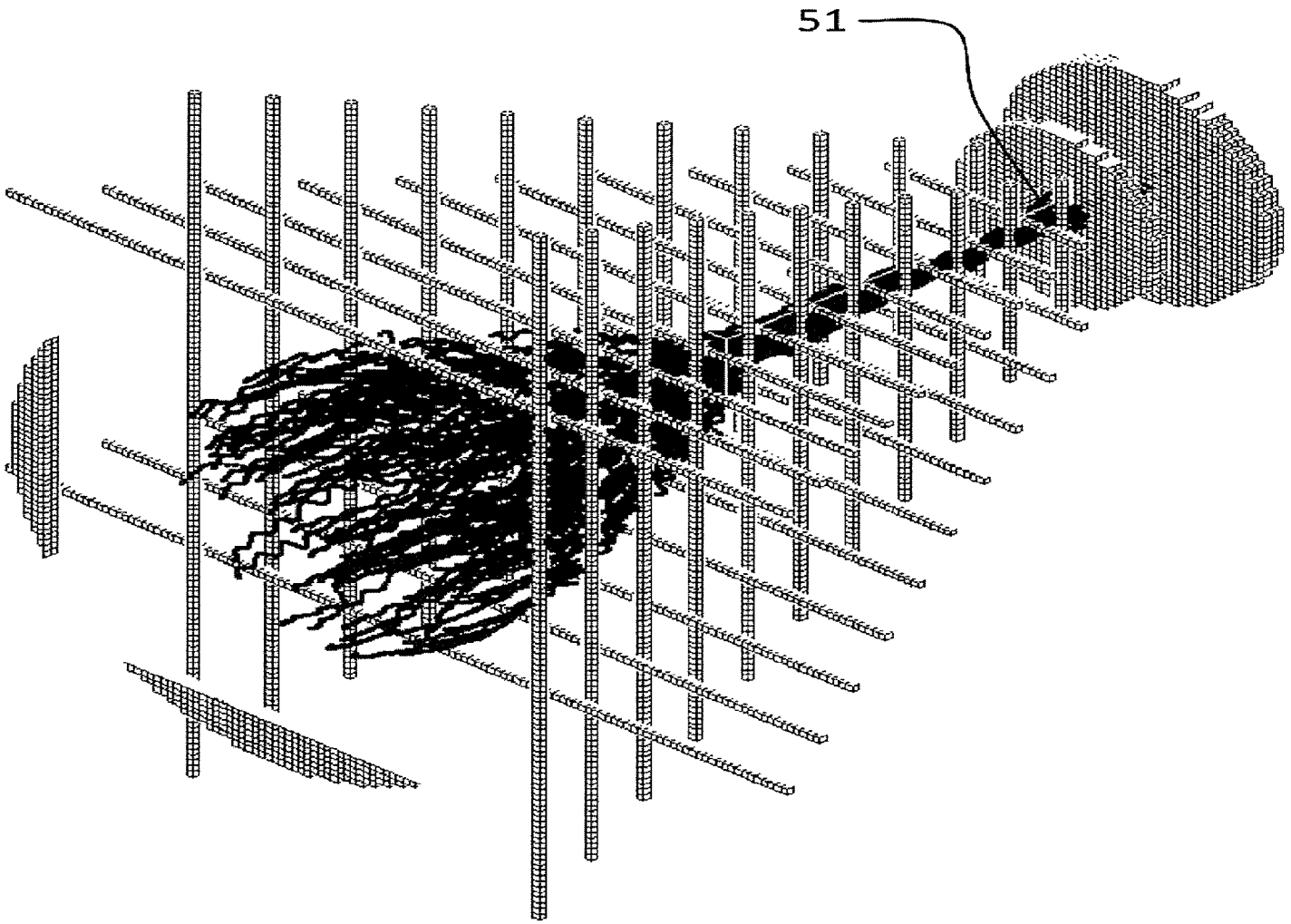
FIG. 5 shows a three-dimensional plot of the simulated convergence of ion trajectories in the ion guide device shown in FIG. 3

Computer simulation is used to prove and estimate this converging process of ion beam in the wire ion guide device. Opposite RF levels were applied to neighboring wire layers and hence the wire layers were defined as two groups. In a specific simulation, the high-frequency voltage applied on each wire group is ±150V (0—peak) sine wave with 1 MHz frequency. The background pressure of ion guide device is 20 torrs (2660 Pa). The distance between wire and guiding axis at the entrance layer is 5.25 mm and gradually reduced to 1.25 mm at the exit layer. The diameter of all wire electrodes is 0.2 mm, and the axial spacing between two layers of wire electrodes is 1 mm. Referring to FIG. 5, the simulation results of the convergence of ion trajectories showed that for ion species within the mass-to-charge range between 100 and 40000 Thomson, most injected ions (>95%) can be guided into the aperture 51.

In the above simulation, the wire electrodes were driven by a high-frequency sine wave RF power supply. Actually, the high-frequency voltage power supply can also be replaced by a group of high-frequency high-voltage switch, which switches the RF potential of different wire electrodes groups between a high DC level and a low DC level with high frequency (>10 KHz). By this method, a high-frequency square wave voltage signal can be induced between wire electrode groups in order to substitute the conventional sine wave radial trapping voltages.

Figure 6:
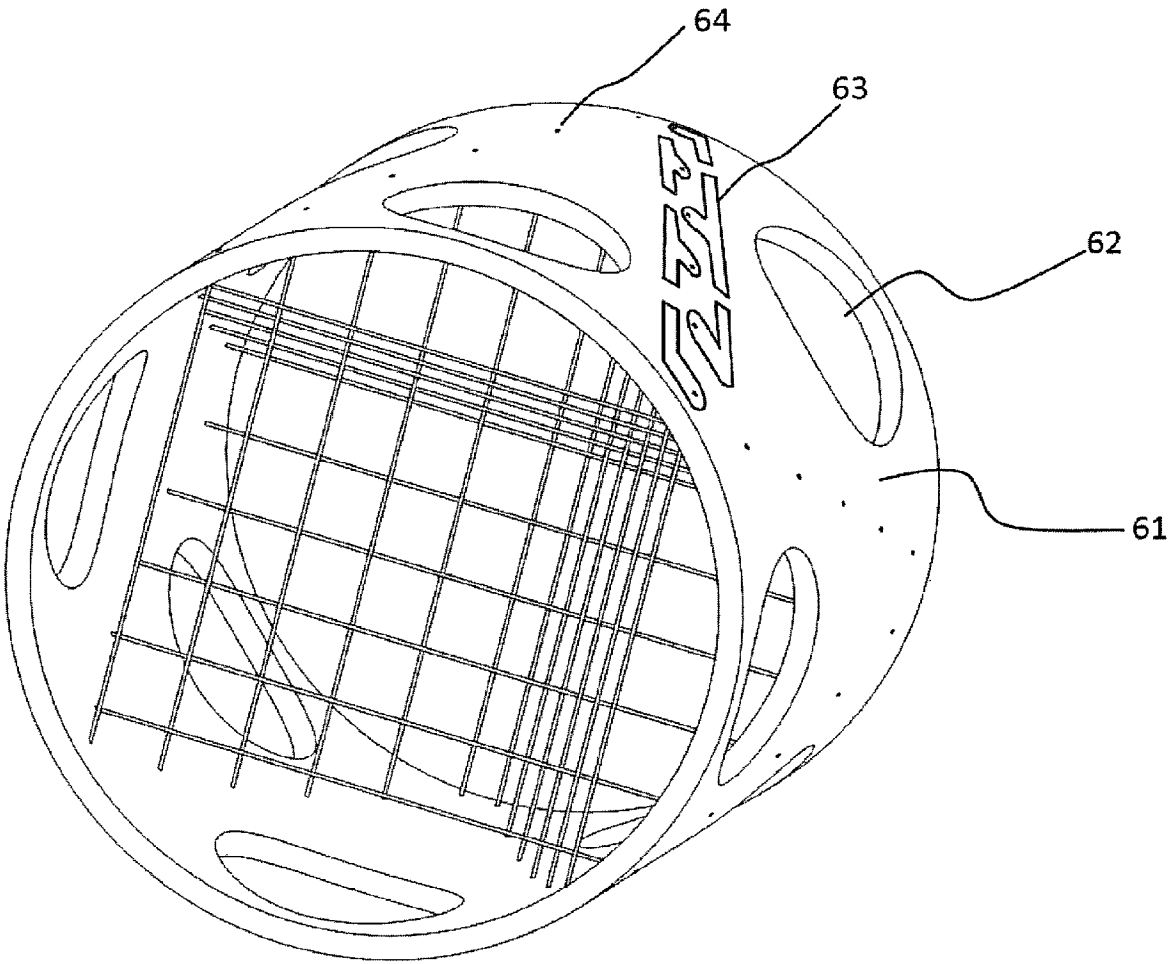
FIG. 6 illustrates a wire ion guide with a cylindrical pipe-shaped holding framework for wire electrodes.

In the embodiment of the invention, a variety of shapes in the frame can be used to fix the wire electrodes. The simplest shape of the frame can be rectangle (FIG. 1) or cylinder (FIG. 6). FIG. 6 shows a wire ion guide device with a cylindrical wall 61 which is made of hard insulating materials such as alumina ceramic, with printed circuit patterns 63 and fix holes 64 on surface. The wire electrodes can be embedded in these fix holes 64 and welded on the cylindrical wall 61. There are also multiple vent apertures 62 on the frame wall to facilitate the neutral gas exhausting.

Figure 7:
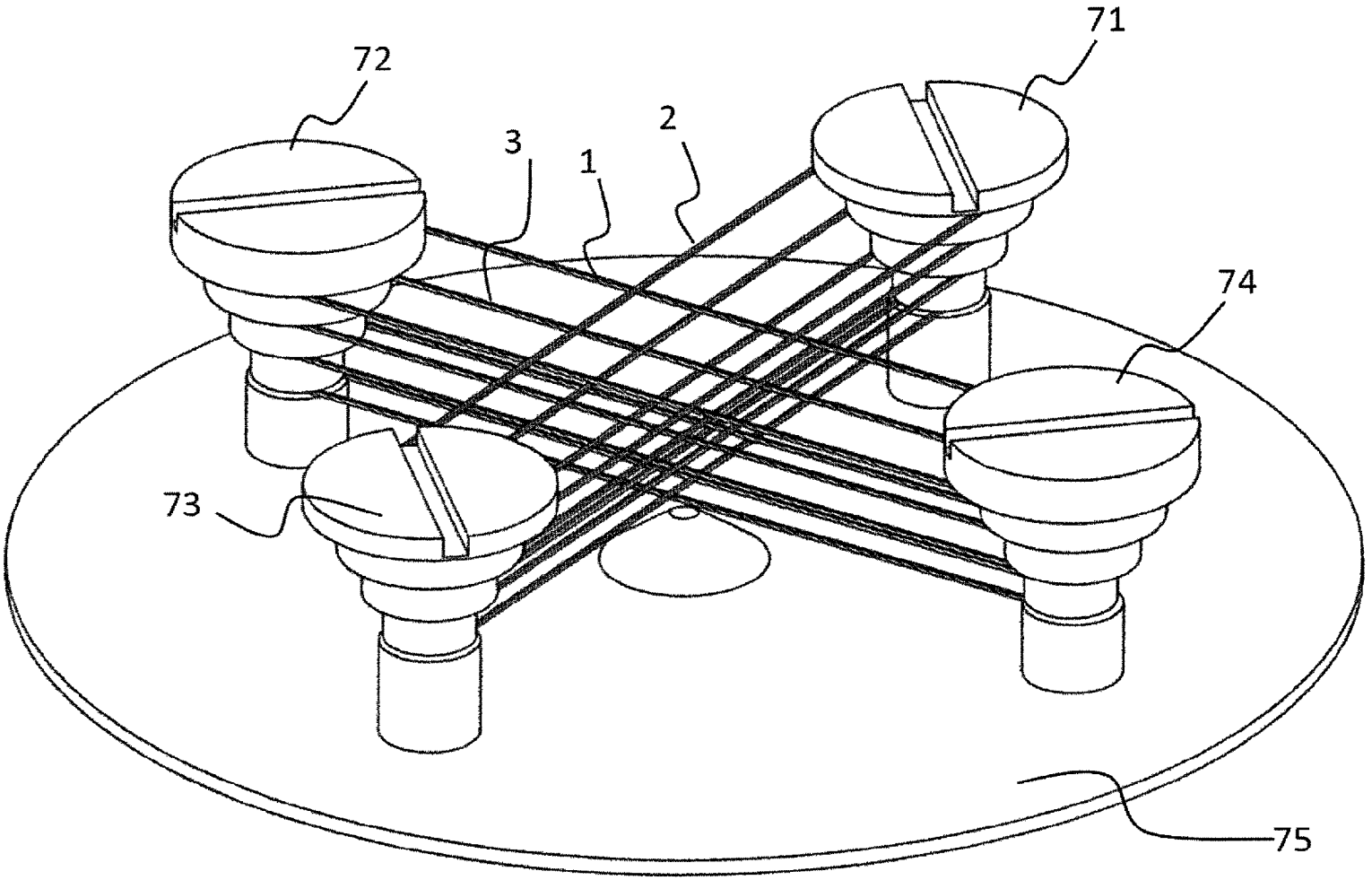
FIG. 7 illustrates a wire ion guide with a holding framework for wire electrodes consisting of four stepping rod column supporters.

Another solution for the supporting structure of wire electrode is a kind of column-shaped bracket shown in FIG. 7. A set of column supporter 71,72,73,74 can be fixed on the skimmer plate 75, while the surface conductive wire 1, 2, 3 . . . are wound in two pairs of column supporter 71, 73 and 72, 74. In this geometry of ion guide device, the position of the wire electrodes does not depend on the mounting holes alignment previously, but be determined by the diameter of the column supporters 71,72,73,74 at different heights.

Figure 8:
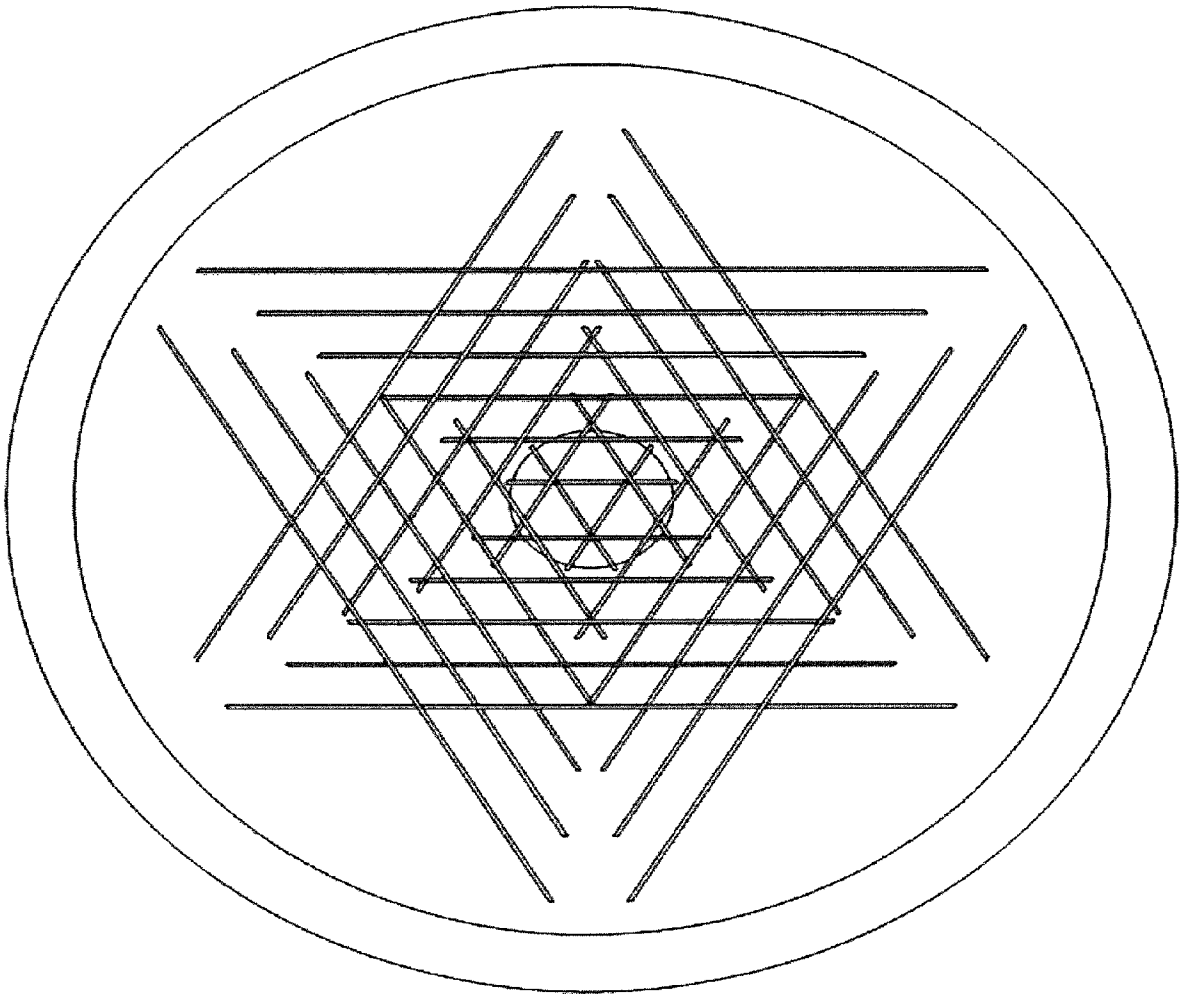
FIG. 8 is a front elevational view for a wire ion guide within radial hexpole trapping field according to the present invention.

In other embodiments of the invention, the wire electrode ion guide device can not only generate quadrupole based focusing field for ion beam focusing, but also be made to generate other forms of multipole radial focusing field such as substantial hexpole or octapole field. As shown in FIG. 8, the wire electrodes of each layer can be stretched into a tight triangle, while the center of each triangle is located at the central axis of the ion guide. All wire electrodes in the next neighboring layer are rotated by 60 degrees around the axis relative to the direction of wire pattern of previous layer. Being similar to the quadrupole wire ion guide, in this embodiment all the even layers of wires are connected to a high-frequency power supply with one output phase by capacitors, while all the odd-layer wires are connected to the high-frequency power supply by capacitor to the opposite output phase. Such wire geometry forms a David star pattern in the view from axial direction and induce substantial hexpole beam focusing field inside the ion guide device.

Figure 9:
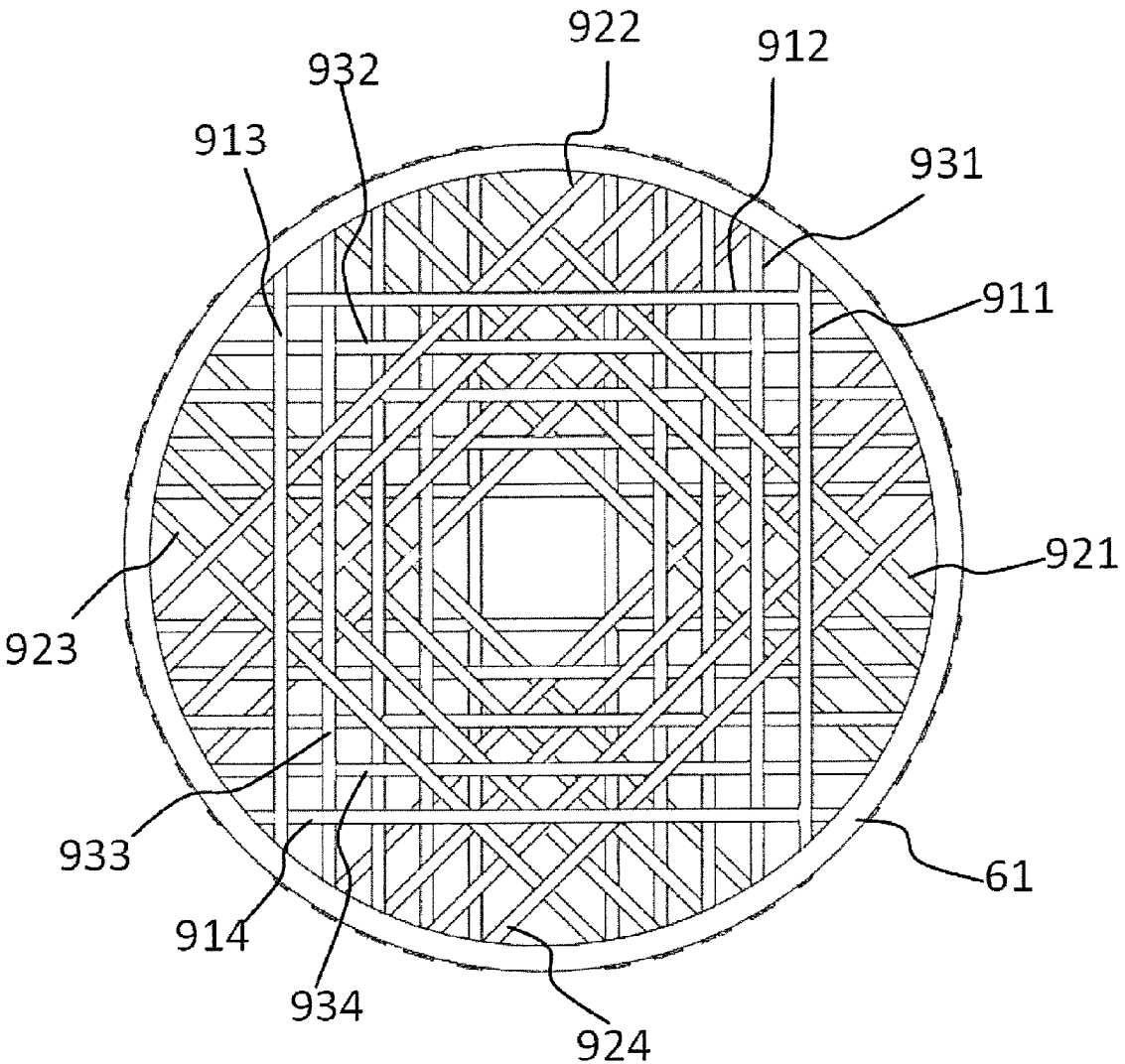
FIG. 9 is a front elevational view for a wire ion guide within radial octopole trapping field according to the present invention.

Similar electrode geometry is shown in FIG. 9. In this example, each wire layer has four wire electrodes (e.g., 911, 912,913,914 . . . ). These wire electrodes are stretched into a square shape (may contact with each other if they have four corners). In the next layer of the wire square pattern (constitutes by wire electrodes 921,922,923,924) is rotated by 45 degrees around the guide axis relative to the direction of wire pattern of previous layer, and repeated periodically, thus forming an octapole trapping field ion guide device. Compared to quadrupole field, the hexapole and octapole fields are weaker for ion focusing in the central part of the ion guide, but stronger near the periphery region.

An advantage of this invention is that the beam convergence characteristics in the wire ion guide device can be different in different region as we select. By selecting the pole number of major multipole field with wire patterns, the convergence performance of ion beam in the center or periphery region can be adjusted. With the innate strong rebound performance of ions around the wire electrode region, the combination of different wire patterns in axial projection view can meet the different characteristics of the ion source and gas flow characteristics under the specific local ion guiding requirements, such as expanding the ion beam radius for lower space charge effect or desolvation process, or focusing the ion beam for adapting small aperture to the next vacuum stage.

In addition to the above perspective, the rotation angle also can be 360/N degrees (N=5, 7, 9, 10, 11 or 12) to achieve other polygon wire patterns with different multipole fields other than quadrupole, hexpole or octapole.

Figure 10:
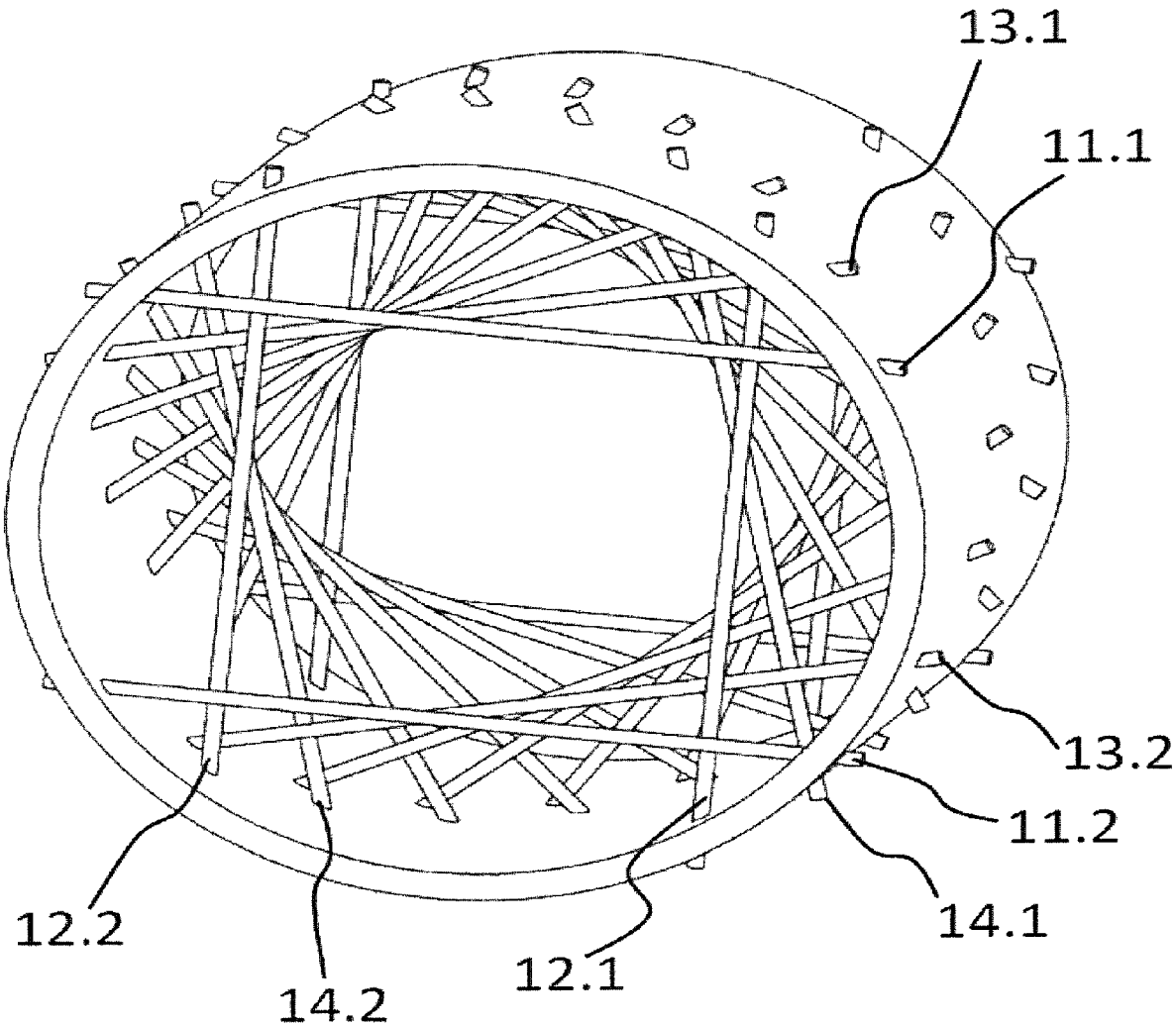
FIG. 10 is a three dimensional view of a wire ion guide within a rotating quadrupole trapping field according to the present invention.

In the above described embodiment, in guide device all the rotation angles around the guide axis between neighboring wire layer were maintained as a constant, for example 90°, 60°, 45°, etc. However, in further embodiments, these rotation angles are not necessarily fixed. For example, FIG. 10 shows the schematics of the ion guide device. Starting from the second layer of wire electrodes, the winding angle between the next layer and previous layer wire patterns can be within such series: 90, 105, 90, 105 . . . degrees. Referring to FIG. 10, the second layer wire electrodes (12.1, 12.2) rotate around the axis with 90 degrees related to the first layer wires (11.1, 11.2), while the third layer wire electrodes (13.1,13.2) rotate around the axis with 105 degrees related to the second layer wires (12.1, 12.2) in the same direction, then periodically repeated. In this wire electrode geometry, if all the even layers of wires are still connected to a high-frequency power supply with one output phase by capacitors, while all the odd-layer wires are still connected to the high-frequency power supply by capacitor to another opposite output phase, a rotating quadrupole field ion guide tunnel can be formed. In this kind of ion guide geometry, the shape of ion beam cloud is also rotated along the guide axis, so that the ion distribution in different moving orientations can be averaged so that the ion cloud shape is more even at the end of ion guide device. This ion guide geometry is more suitable for the case of ion transmission with the existence of the rotating gas flow.

As a further extended embodiment, the phase difference of the high-frequency potential applied between neighboring layers of wire electrode may not be exactly 180 degrees. If the high-frequency potentials applied between neighboring layers of wire electrodes are 120 or 90 degrees, within 3 or 4 wire layers, the phase shift on wire layers go through one cycle. This embodiment can be further extended to make the phase difference of high frequency potential between neighboring layers as 360/M degree, where M is an integer greater than one. M different phases of high frequency potential waveform are provided to the wire electrode layer $1^{st}$ to $M^{th}$ according to the layer sequence along the axis. Such phase-relation pattern repeats within M layers a cycle periodically. In this device, periodic multiphase wire layers can induce a high frequency axial electric field and produce axial travelling wave along the guiding axis to facilitate the guiding to ions towards the direction of transmission. Advantageously, in this case, it is not necessary to introduce an axial DC potential gradient for driving ions, so that the upstream and downstream ion optics of the travelling wave wire ion guide can be substantially equipotential. This can avoid using complex high voltage bias circuit for the serial ion optics linked with the wire ion guide device.

The above descriptions show the example of ion guide example using periodic phase high-frequency voltage to transmit ion along the guide axis. As an extension of this travelling wave ion driving method, the pattern of phase shifts applied on the wire layers can be non-periodic. In this situation, a series of multiphase high frequency potential are applied to these neighboring layers of wire electrodes, which induce an alternating high-frequency electric field between neighboring layers, even in this situation, the alternating electric field inside ion guide device also contains a converge component toward the ion guide axis. The local speed of traveling wave can be adjusted with those phase shifts of high-frequency voltages applied on the neighboring wire layers.

Considering the effect of gas flow, when a gas flow with the same direction and enough strength as the electric field exists inside the wire ion guide device, even without the help of additional axial DC potential gradient (e.g., for positive ions, along the axis of the guide potential gradient is relatively positive to negative from inlet to outlet) or travelling waves, ions in the wire ion guide can be effectively transmitted with the help of high-frequency radial electric field in the wire ion guide. A backward DC gradient (e.g., for positive ions, along the axis of the guide potential gradient is relative negative to positive from inlet to outlet) can also be applied at least on a segment of the ion guide, for blocking high mobility charged particle species. Either the gas flow rate or backward axial potential gradient can be changed in order to separate the ions according to their mobility.

Figure 11:
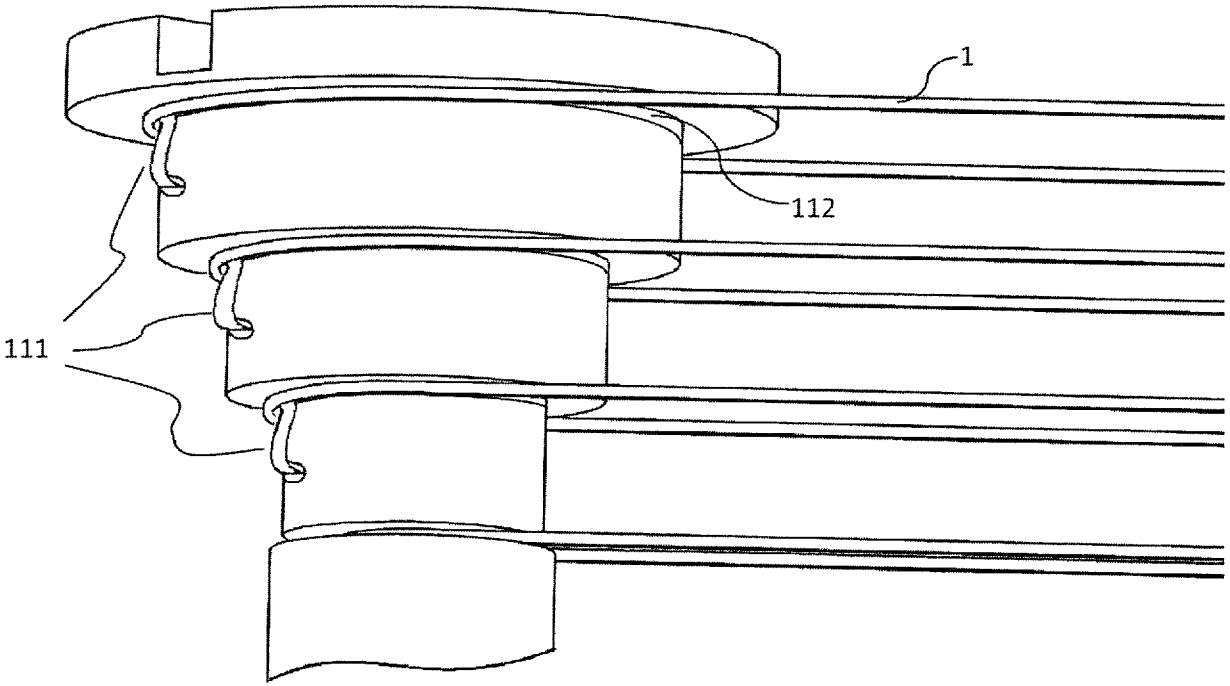
FIG. 11 illustrated a way of fixing wire electrode by stretching with spring plates with tension.
Figure 12:
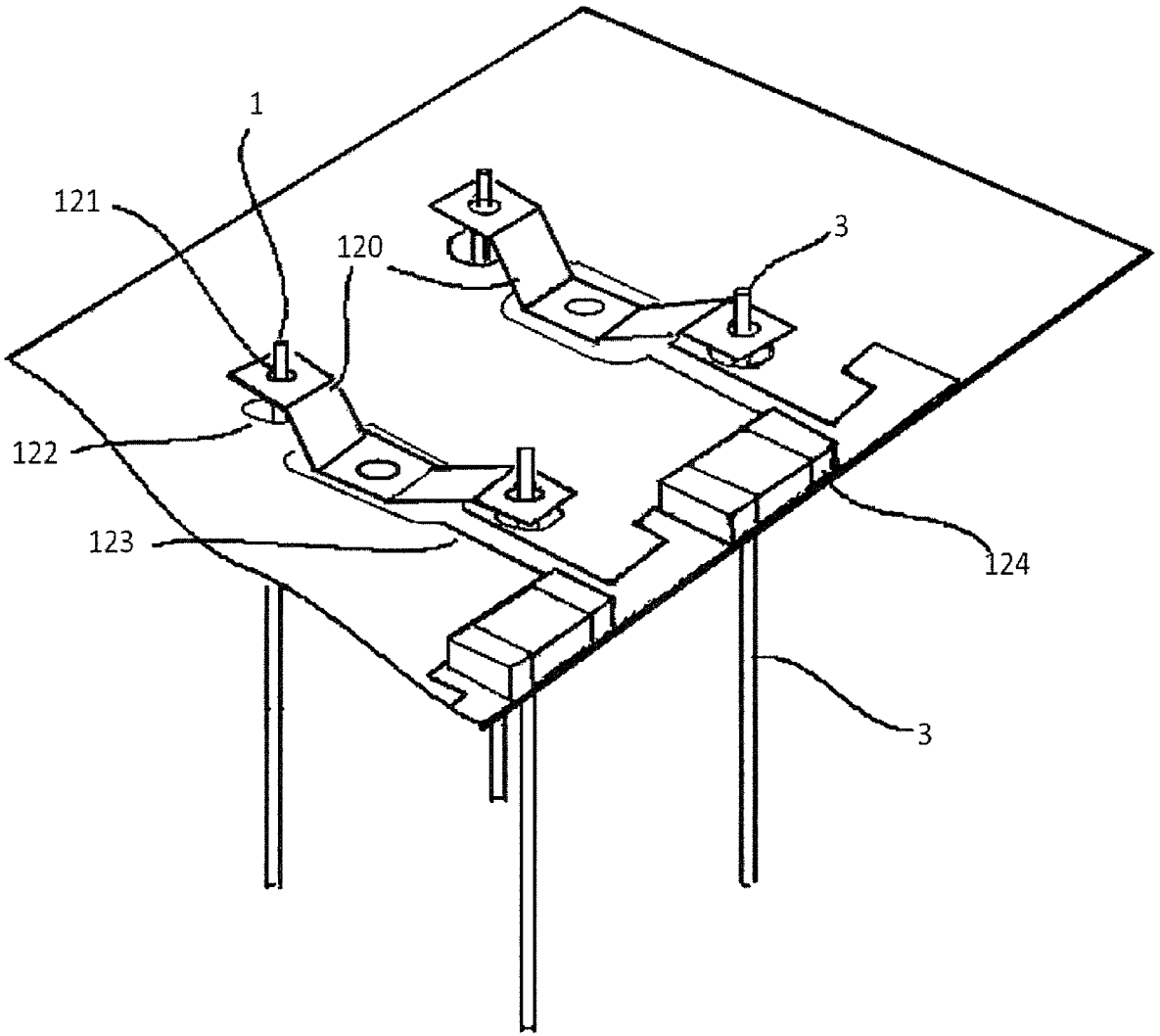
FIG. 12 illustrated a way of fixing wire electrodes by welding and stretching with spring plates with tension.

Viewed from the installation process, the entire wire electrodes should be straightened with high tension and the external mounting bracket should have a solid structure and accurate scale. In order to achieve these goals, FIG. 11 shows to use steel retainer 111 to provide tension, and wire electrodes 1 is limited at a preset axial position with a slot 112 grooved on the column supporter. For the frame bracket structure, FIG. 12 shows that the required tension of wire can be provided by elastic soldering lug 120. In such case, the wire electrode 1 will pass through the alignment holes 122 on the printed circuit board 123, and be soldered at the lug hole 121 on the elastic soldering lug 120, while the elastic lug 120 is welded to the printed circuit board 123 on the conductive pad. In FIG. 12, it also shows part of resistor/capacitor (RC) vessels 124 welding on the same printed circuit board 123, constituting a DC/RF coupling circuit unit. These units can be assembled to achieve different functions such as DC/RF distribution along the axial direction. The printed circuit board 123 can also be used to install these devices and leads, connectors, etc. to assemble discrete wire electrodes and their driving circuit into an ion guide device.

Figure 13:
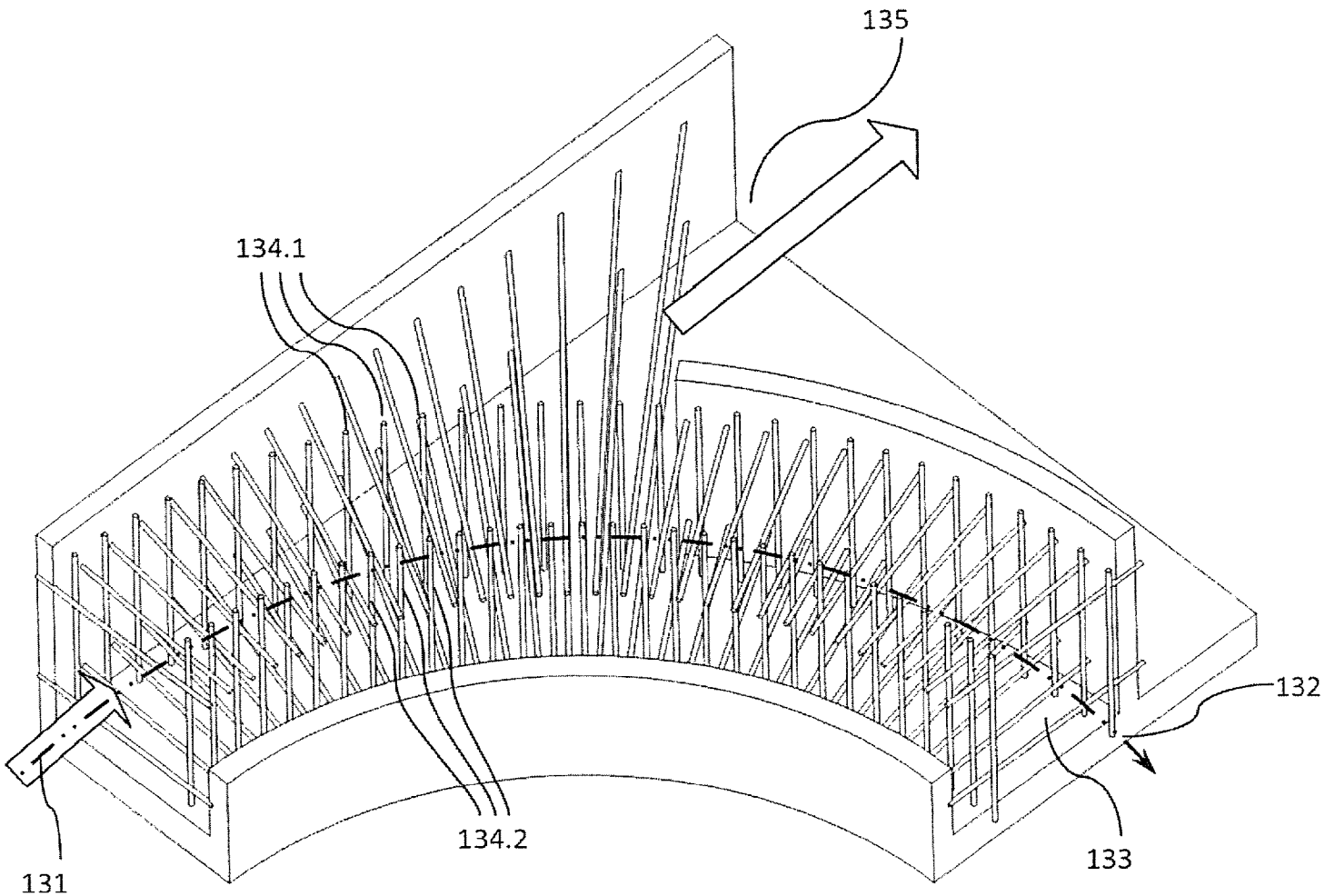
FIG. 13 illustrated a wire ion guide device with a curved ion guiding axis according to the present invention.

In preferred embodiment of present invention, the plane in which wire electrodes of each layer are located is roughly vertical to the ion guiding axis. For example, angle between the layer plane and guiding axis is set to between 85° to 95°. It is understandable that there is no severe impact on ion focusing efficiency if the wire electrode is not vertical to the guiding axis strictly. Typically, the angle between the layer plane and guiding axis can be defined in the range of 90+/−20 degrees, i.e. 70°-110°. In addition, the guiding axis defined in embodiment of the invention is not necessarily a straight line. A curved ion guiding axis can also exist in the wire ion guide device. FIG. 13 gives an example for this curved ion guide device comprising a plurality of straight wire electrodes. In this example, the ion guiding axis 132 is in an arc shape. Ion and neutral gas flow 131 can get into the guiding device along tangent of central axis at the inlet. The focusing electric force can drive ions to region near axis and finally get to the outlet 133 along this curved guiding tunnel. Meanwhile, the neutral gas flow rushes toward the exhaust port 135 along the original direction. Except for applying an axial potential gradient as that in a straight guide device case, it is also allowed to superimpose another DC potential difference between each two vertical wires on odd number layers, such as between wire 134.1 and wire 134.2. In such case, an additional deflecting force was applied on ions to prevent them being pushed away from the guiding direction with the strong gas flow.

The purpose of the embodiments mentioned above is just to indicate the possibility in fabricating this multi-layer wire ion guiding device. It also gives rough approaches and some technical details for fabrication of the ion guide device. However, the wire distribution and electric field structure are not limited to the forms we have described above in present invention. For example, wire electrodes can be in the form of pentagon, pentagram, rectangle, or even hexagon or octagon, etc. Understandably, in these embodiments, it is better to distribute wire electrodes in the similar form between layers. But it is still allowed to have difference in geometry size while with similar geometry form between layers. It is also allowed to have a slight difference in geometry form between layers.

Moreover, voltages applied to wire electrodes can be in the form of square wave, sawtooth wave, pulse sequence or the combination of these forms. As for amplitude of RF voltage which is used to confine ions radially, it is not necessarily the same between layers. For instance, one can change this amplitude applied on wire electrodes of at least some of layers according to distance between two parallel wires on the same layer with the purpose to select ions of different mass-to-charge ratio. Taking that shown in FIG. 3A as an example, wherein an ion guiding device is driven by an RF quadrupole electric field, the effect of quadrupole field to the stability of trajectories of ions with different mass to charge ratios can be described by a parameter q based on quadrupole mass spectrometry theory. The q value is roughly inversely proportional to square of distance between two parallel wires on the same layer and mass to charge ratio of selected passing ions, while it is proportional to RF voltage amplitude applied on wire electrode. In the specific design, we can set certain values in RC network (17 and 18) similar as shown in FIG. 1, and consequently to change the RF voltage statically or dynamically according to either the m/z of ions which are expected to pass or the distance between two parallel wires. As a result, we can control parameter q which is corresponding to radial stable trajectory of ions in a preselected m/z range. And finally, ions in a certain m/z range can be selected to pass or not. Moreover, ions can be selected axially in a similar way. We can also generate an equipotential barrier axially in order to blocking/trapping certain ions temporarily. That is because this potential barrier is also related to mass to charge ratio of ions. This feature can even be used to desolvate droplets in ESI to get better ion transmission. For example, we can trap large droplets between layers for longer time to get better desolvation.

Furthermore, for DC voltage which is used to produce axial potential, it is not a must in form of arithmetic distribution between layers. As an alternative, this distribution can be changed by setting values in resistor network 18 as needed. For example, a rather negative DC voltage can be applied on certain layers firstly with the purpose to capture ions in this region. Then the DC voltage distribution returns to normal and ions can be released. Another example is to accelerate ions with the axial electric field, or to oscillate ions with a high frequency RF voltage in radial/axial direction, which can increase the number of collisions between ions and neutral gas molecules at high gas pressure. The collision induced reaction product ions, ion fragments or desolvated products can then be guided into analyzer.

There are actually many combinations of variations of embodiments we have described above and we do not necessary to elaborate here. People skilled in the art should be capable of forming practical embodiments by combining the variations of embodiments we described.

For example, the part or whole of straight wire electrodes can be made of thermal resistance materials. A current supply which supplies heating current can be applied between the ends of resistance wire. The heating effect and accompanied infrared rays (IR) can be used to help desolvation, thermal dissociation, IR dissociation of the target ions, etc. In addition, as a variant of the resistance wire, the high permeability material can also be used to make the wire electrodes. A high frequency AC voltage supply, rather than a current supply, is in need to supply the heating by the magnetic inductive eddy current which is similar to that in an induction cooker.

Figure 14:
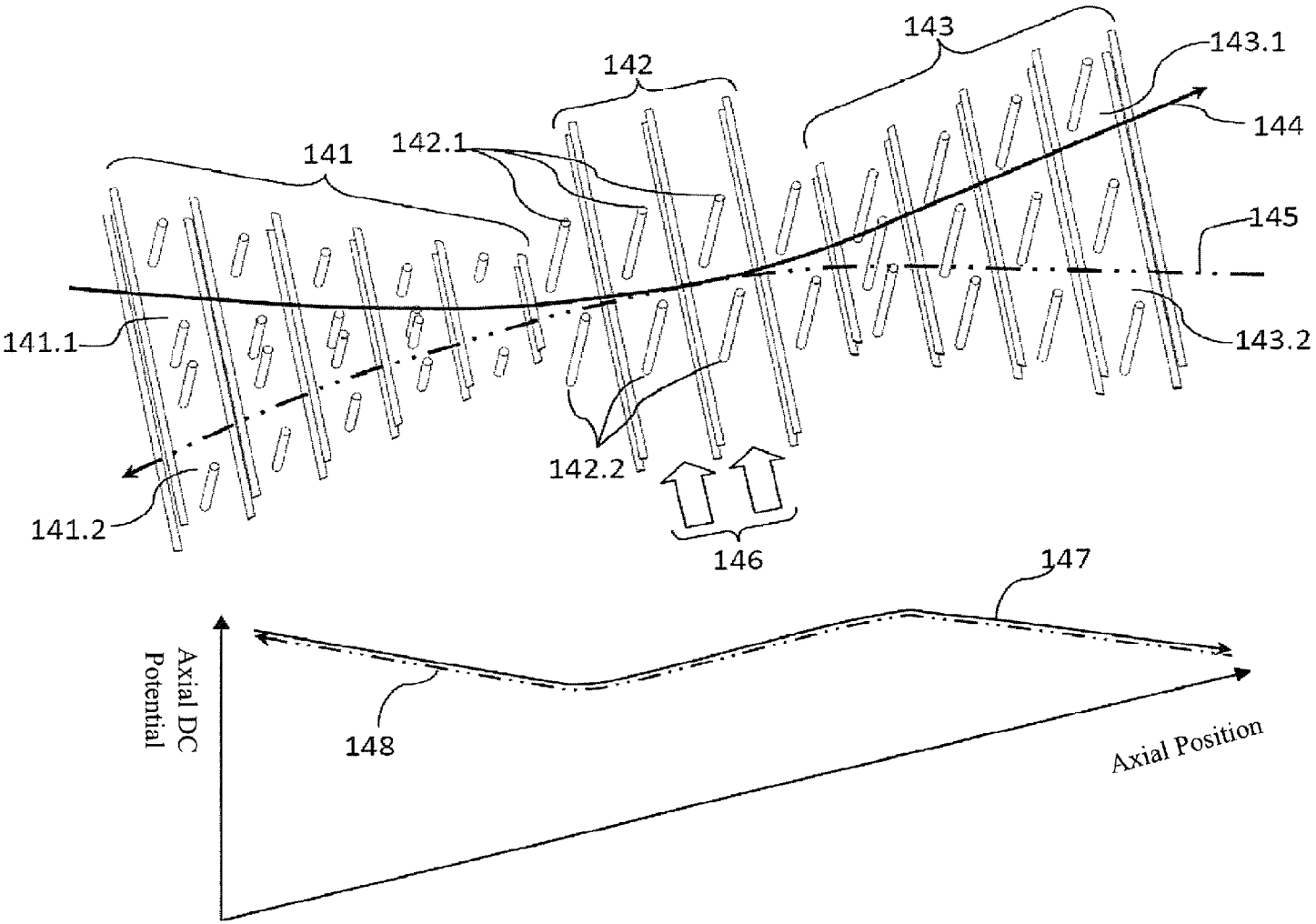
FIG. 14 illustrated a wire ion guide device used for mixing the positive and negative ions and introducing additional collision gas.

Another example is to combine multiple said guide devices (as shown in 141.1 and 141.2 of FIG. 14) by sharing some of the wires (as shown by 143.1 and 143.2) in order to improve device's transmission capability further. As shown in FIG. 14, we can also combine multiple said guide devices segments 141, 142 and 143 in series. Through the use of the ion guide device, multiple ion sources and ion analyzers can be in the form of one to many (ion beam splitter), many to one (multiplexer), and many to many (exchanging device).

Combination of ion guiding devices shown in FIG. 14 also allows gathering, mixing and separating positive ion flow 144, negative ion flow 145 and neutral molecules flow 146. It is aimed to dissociate target ions with ion-molecule reaction or charge transfer process. Then separated product ion flow will be obtained for analysis in tandem mass spectrometry. For instance, as shown in the system, a descending DC bias offset from left to right on wires at each layer can be supplied by peripheral circuitry. In such case the positive ion flow 144 will be guided by a step-down axial DC potential distribution 147 along its flow direction. Meanwhile, negative ion flow 145 in a reversed flow direction is guided by a step-up axial DC potential distribution 148 along its flow direction. These two flows are guided into the middle segment part 142 of the device and then mixed with each other. In the segment 142, both positive and negative ion flows are affected by a quadrupole field. They are converged toward the central axis of guide device segment 142 where the reaction would happen. Product ions can be obtained as in so-called electron transfer dissociation (ETD) process. These new positive and negative product ion flows can then be bended to different directions and finally be separated at exit of device by superimposing a DC potential difference between wire electrodes group 142.1 and 142.2 for deflecting. Furthermore, with the open structure of this wire ion guiding device, appropriate collision gas through the neutral molecules flow 146, such as argon, isobutane, etc. can be introduced into the middle segment part 142 to increase residence time of both positive ion flow 144 and negative ion flow 145. The collision gas through the neutral molecules flow 146 can also be used as catalyst to improve dissociation efficiency as a result of enhancement in charge transfer process.

Figure 15:
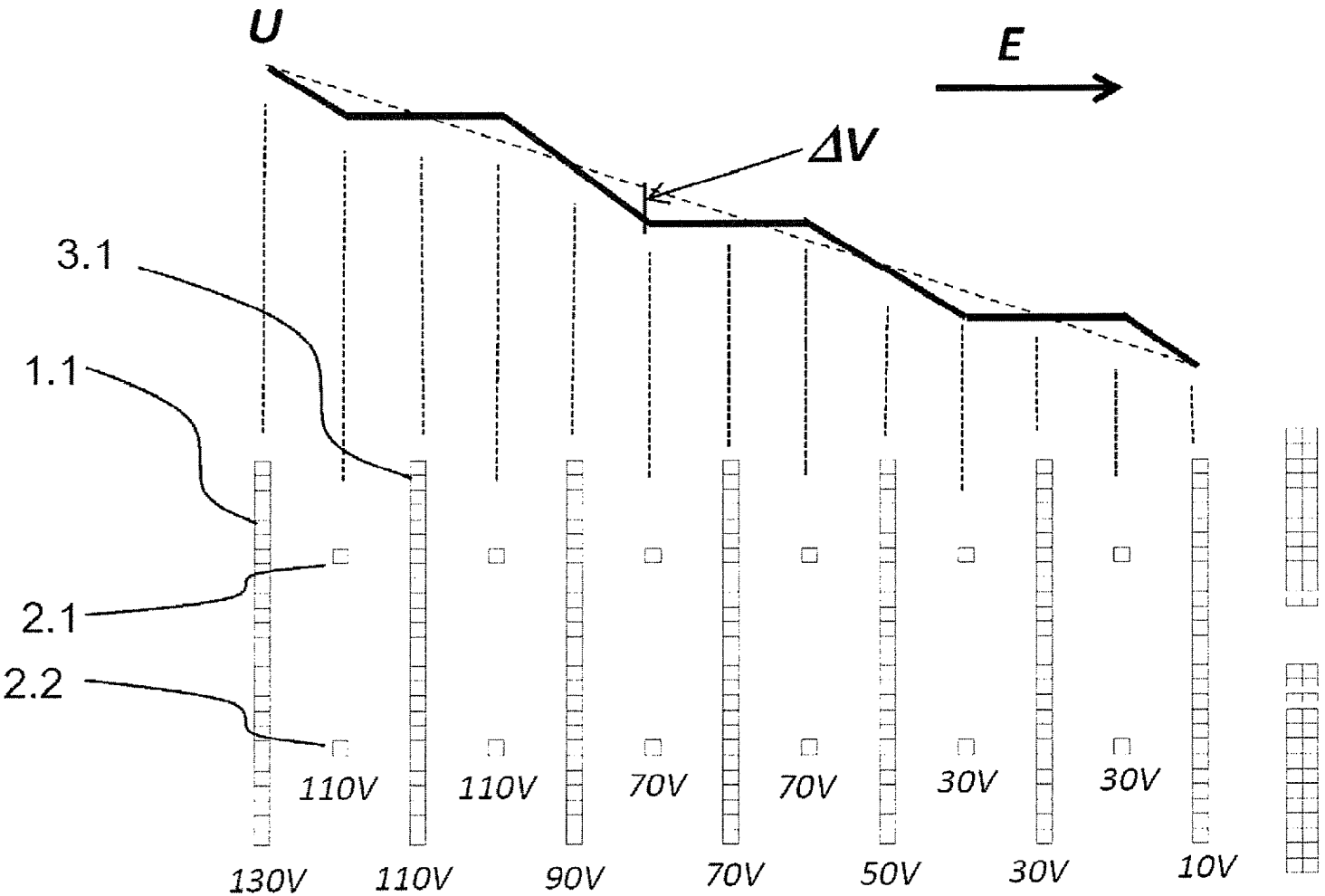
FIG. 15 shows a focusing ion guide device driven by spatially periodic DC potential on the wire electrodes, among which four layers form a period.
Figure 16:
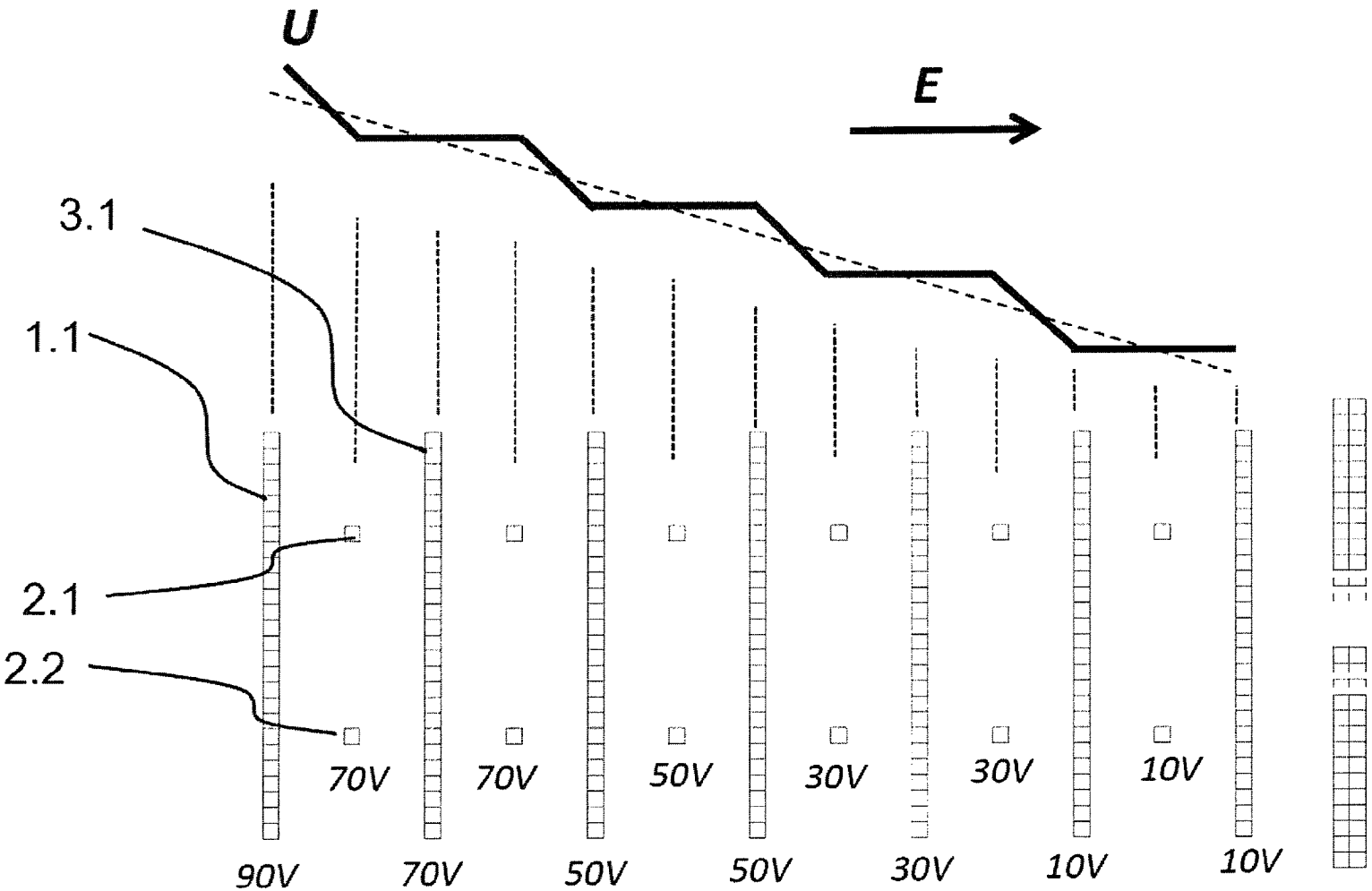
FIG. 16 shows a focusing ion guide device driven by spatially periodic DC potential on the wire electrodes, among which six layers form a period.

Finally, it should be pointed that in this ion guiding device, the focusing effect to ions can also be achieved by applying particular DC voltages only on wire electrodes. When different DC voltages are applied on these wires, a variable DC electric field strength along guiding axis is produced inside the guiding tunnel. By setting these DC voltages, a DC electric field component can be formed to focus ions in the radial direction. FIG. 15 gives an example how it works. Here each layer is comprised of a pair of parallel straight wires termed as n.1, n.2 (n is layer number, and n is an integer). Wires 2.1, 2.2 on the second layer are perpendicular to wires 1.1, 1.2 on the first layer. Wires 3.1, 3.2 on the third layer are perpendicular to wires 2.1, 2.2 on the second layer. Wires 3.1, 3.2 on the third layer are parallel to wires 1.1, 1.2 on the first layer, and so on. Values of electric potential of wires on each layer are noted in figure. Change of values is also noted in U curve. It can be seen that in addition to a descending DC voltage on each layer, a periodic DC bias +/−ΔV is also superimposed on wires of the adjacent layers. For example, when ΔV=10V, potentials on each layer are 130V, 110V (120−10), 110V, 110V (100+10), 90V, 70V (80−10), 70V, 70V (60+10), 50V, 30V (40−10), 30V, 30V (20+10), 10V. The resulting electric field strength changes periodically along the guiding axis in every four layers. This feature is similar to that of a linear array composing of DC quadrupole lenses with opposite DC potentials on two neighboring lenses. The lens array can focus and defocus ions periodically in axial direction. Under the effects of both the DC electric field gradient and the gas flow, axial velocity of ions can reach to tens to hundreds of meters per second. The ions are focused and then defocused once in a distance of a few millimeters. This focusing effect in radial direction is equivalent to what ions experience in a quadrupole field at the same place which is generated by an RF voltage with frequency of a few thousand to hundreds of thousands Hz as shown in FIG. 16. The same DC voltages are applied to three pairs of wires on adjacent layers. One can make each three layers as a group and lower DC voltages between groups. Then the DC electric field can focus and defocus ions periodically every 6 layers in axial direction. Under the effects of both focusing/defocusing and collisional cooling, ions can be focused effectively in radial direction.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An device for ion guiding, comprising:

electrodes made of fine wire, disposed in multiple layers along an axis which defines the ion guiding direction;

a voltage supply for supplying voltages to said wire electrodes in each layer to generate at least an electric field that focuses ions towards the said guiding axis;

wherein said wire electrodes of each layer comprise at least two fine wires that are held straight and positioned with certain distance from the said guiding axis, and said wire electrodes of each layer are rotated a fixed angle about the guiding axis with respect to those of the neighboring layers so that the wires in multiple layers form a cage-like structured transparent ion guiding tunnel around the guiding axis; and a power supply for providing voltages to wire electrodes of each layer in order to form focusing field along the ion guiding axis.

2. The device for ion guiding as claimed in claim 1, further comprising a holding framework located outside the said ion guiding tunnel, for holding the said fine wire electrodes.

3. The device for ion guiding as claimed in claim 2, wherein the said fine wire electrodes are held by the said holding framework by means of welding, soldering, clamping or wrapping around.

4. The device for ion guiding as claimed in claim 2, wherein the holding framework contains holes for passing the fine wires and is plated with printed circuit.

5. The device for ion guiding as claimed in claim 2, including a stretching mechanism made with elastic material disposed on said holding framework.

6. The device for ion guiding as claimed in claim 2, wherein said wire holding framework is made in partial with the wall of the ion guiding device.

7. The device for ion guiding as claimed in claim 6, wherein the said wall of the ion guiding device has opening aperture for exhausting gas.

8. The device for ion guiding as claimed in claim 1, wherein the angle between the plane of each layer of wire electrodes and the guiding axis is in the range between 70 to 110 degrees.

9. The device for ion guiding as claimed in claim 8, wherein the angle between the plane of each layer of wire electrodes and the guiding axis is in the range between 85 to 95 degrees.

10. The device for ion guiding as claimed in claim 1, wherein all wires on each layer of wire electrodes have same distance to said guiding axis.

11. The device for ion guiding as claimed in claim 10, wherein at least two wires on each layer of wire electrodes are parallel to each other.

12. The device for ion guiding as claimed in claim 1, wherein said wire electrodes of each layer are rotated an angle of 360/N degrees about the guiding axis with respect to those of the previous layer, where N=4, 5, 6, 7, 8, 9, 10, 11 or 12.

13. The device for ion guiding as claimed in claim 1, wherein the wire electrodes of each layer include a pair of fine wires which have substantial equal distance from the guiding axis and are kept parallel to each other.

14. The device for ion guiding as claimed in claim 1, wherein the voltage supply includes DC voltage supplies for providing DC voltages to said wire electrodes of different layers, resulting in a variation of DC electric field strength along the guiding axis in the ion guiding channel wherein a component of said DC electric field enables ion focusing towards the guiding axis.

15. The device for ion guiding as claimed in claim 14, wherein the resulted DC electric field strength along the guiding axis is periodically varied in the ion guiding channel.

16. The device for ion guiding as claimed in claim 1, wherein the said ion guiding axis is a curved guiding axis.

17. The device for ion guiding as claimed in claim 16, further including a DC voltage supply for applying a DC potential difference between wire electrodes within a layer for at least one of the layers, to assist the ion deflection along the curved guiding axis.

18. The device for ion guiding as claimed in claim 1, in which a flow of gas runs through at least part of its volume, and the pressure range of the said gas flow is between 0.075 and 75 torrs.

19. The device for ion guiding as claimed in claim 1, wherein the diameter of said fine wire is less than 0.5 mm.

20. The device for ion guiding as claimed in claim 1, wherein at least one of the wire electrodes are used as heater by applying a current.

21. A joint group of ion guide device, comprising a plurality of ion guide devices as claimed in claim 1, wherein at least some of wire electrodes are shared among said plurality of devices for ion guiding.

22. A joint group of ion guide device, comprising a plurality of ion guide devices as claimed in claim 1, wherein the guiding axes of the plurality of ion guide devices are converged, diverged, or merged together.

23. The device for ion guiding as claimed in claim 1, wherein the said voltage supply includes high frequency voltage supply for supplying high frequency voltages to said wire electrodes of different layers to generate at least the electric field enabling ion focusing towards the guiding axis.

24. The device for ion guiding as claimed in claim 23, wherein the mean for supplying high frequency voltages to said wire electrodes of different layers includes supplying high frequency voltages in different phase between the wire electrodes of adjacent layers.

25. The device for ion guiding as claimed in claim 24, wherein the mean of supplying high frequency voltages to said wire electrodes of different layers includes supplying high frequency voltages in opposite phase between the wire electrodes of adjacent layers.

26. The device for ion guiding as claimed in claim 24, wherein at least the distance between the guiding axis and wire electrodes in the group applied with high frequency voltages in same phase decreases along the guiding axis.

27. The device for ion guiding as claimed in claim 24, wherein said high frequency voltage supply supplies high frequency voltages to wire electrodes of different layers by means including, supplying voltages with same frequency but in M sequential phases to wire electrodes from first to $M^{th}$ layer, with phase difference between neighboring layers being 360/M degrees, and allowing the phase order continue after the $M^{th}$ layer, where M is an integer larger than 1.

28. The device for ion guiding as claimed in claim 23, wherein said voltage supply includes a DC voltage supply which is able to superimpose different DC voltage levels on wire electrodes of at least part of layers to form a potential gradient along guiding axis.

29. The device for ion guiding as claimed in claim 28, including a gas flow in line with the ion guiding axis, wherein the direction of ion drift motion caused by said potential gradient along the guiding axis is opposite to the direction of said gas flow allowing only ions with certain mobility to be transferred effectively.

30. The device for ion guiding as claimed in claim 28, wherein the voltage of said high frequency voltage supply and said potential gradient along guiding axis are adapted to cause ions entering the ion guide device to collide with the neutral gas molecule effectively, and to allow the product ions, fragmented ions or desolvated ions which are resulted from said collisional reaction to be transferred effectively.

31. The device for ion guiding as claimed in claim 23, wherein the high frequency voltage supply supplies high frequency voltages to said wire electrodes of different layers by means including, providing said wire electrodes of different layers with high frequency voltage at different amplitudes.

32. The device for ion guiding as claimed in claim 23, wherein said high frequency voltage supply includes a number of high voltage high frequency switches used for generating rectangular wave high frequency voltage.

33. The device for ion guiding as claimed in claim 23, wherein the space between adjacent wire electrodes and said high frequency voltage in at least a part of wire electrode layers are adapted to cause the ions in the space adjacent to said wire electrodes to pass, stop or be dispelled selectively according to their mass to charge ratio.

* * * * *